United States Patent [19]

Kurihara et al.

[11] Patent Number: 4,509,421

[45] Date of Patent: Apr. 9, 1985

[54] PRINTER HEAD FOR A DOT LINE PRINTER

[75] Inventors: Toshio Kurihara; Masao Kunita; Makoto Yasunaga; Katuya Masuda; Takashi Moriya; Seiichi Oosawa, all of Tokorozawa, Japan

[73] Assignee: Citizen Watch Company Limited, Tokyo, Japan

[21] Appl. No.: 450,585

[22] Filed: Dec. 17, 1982

[30] Foreign Application Priority Data

| | | | |
|---|---|---|---|
| Jul. 23, 1982 | [JP] | Japan | 57-128671 |
| Oct. 26, 1982 | [JP] | Japan | 57-162251[U] |
| Oct. 26, 1982 | [JP] | Japan | 57-162252[U] |
| Oct. 26, 1982 | [JP] | Japan | 57-162253[U] |

[51] Int. Cl.[3] ..... B41J 3/12

[52] U.S. Cl. ..... 101/93.04; 101/93.48

[58] Field of Search ..... 101/93.04, 93.05; 400/124

[56] References Cited

U.S. PATENT DOCUMENTS

| | | | |
|---|---|---|---|
| 4,033,255 | 7/1977 | Kleist et al. | 400/124 |
| 4,044,668 | 8/1977 | Barrus et al. | 101/93.04 |
| 4,258,623 | 3/1981 | Barrus et al. | 101/93.04 |
| 4,351,235 | 9/1982 | Bringhurst | 101/93.04 |
| 4,368,353 | 1/1983 | Ando et al. | 101/93.04 |

FOREIGN PATENT DOCUMENTS

| | | | |
|---|---|---|---|
| 27376 | 3/1981 | Japan | 101/93.04 |
| 44674 | 4/1981 | Japan | 101/93.05 |
| 15980 | 1/1982 | Japan | 101/93.04 |
| 93168 | 6/1982 | Japan | 101/93.05 |

*Primary Examiner*—Edgar S. Burr
*Assistant Examiner*—M. J. Hirabayashi
*Attorney, Agent, or Firm*—Jordan and Hamburg

[57] ABSTRACT

A printer head of improved design for a dot line printer, for high speed data printout. The printer head features independent magnetic circuits for driving each of the printer needles which form printed dots, with the magnetic circuits acting on armatures carrying the printer stylus, the armatures being mounted on the free ends of leaf springs. The leaf springs can be designed for optimum performance, irrespective of magnetic circuit considerations, and the head assembly is based on a lightweight non-magnetic frame. Substantially higher printing speeds than have hitherto been possible are attainable, due to reduced heat buildup in the drive coils, reduced interference between adjacent magnetic circuits, and optimized spring performance.

8 Claims, 4 Drawing Figures

PRINTER HEAD FOR A DOT LINE PRINTER

BACKGROUND OF THE INVENTION

The present invention relates to a dot line printer of mechanical type, for performing dot matrix printing of characters, graphics etc in data processing applications, and in particular to an improved printer head for use in such a dot line printer.

Various types of device have been utilized for high-speed printout of characters, numerals, graphics etc, in data processing applications. The mechanical types of high-speed printers offer some advantages over non-mechanical printers, such as a capability for simultaneous generation of a number of copies while printing is taking place. The highest printing speeds available with mechanical printer are provided by the dot matrix printers, in which characters, etc, are printed as a pattern of dots, with the dots being printed by impact of suitable narrow elements in the form of thin wires or rods, on the printer paper, acting through a printer ribbon. In one form of such printers, referred to generally as a dot line printer, the narrow stylus-shaped printer elements (which will be referred to in the following as printer rods) are arrayed in line and mounted in a printer head, which is driven to shuttle horizontally from side to side, with the printer rods being positioned with their tips closely adjacent to a printer ribbon which passes close to the surface of the printer paper. As the printer head traverses the printer paper in one direction, the printer rods are actuated to impact on the paper such as to successively print sets of dots, with these dots forming parts of the characters, etc. which are to be printed. Upon completion of that traverse of the printer head, the printer paper, generally carried on a platen, is advanced vertically by one dot pitch, whereupon the printer head performs another traverse in the opposite direction, and another series of dots are printed to form the next part of each of the characters. Thus, characters, etc, can be printed in the form of matrices of dots, by cumulative traverses of the printer paper by the printer head and successive advancements of the paper. The shapes of the characters or graphics which are printed in this way are determined by electrical signals which control the actuations of the printer rods, supplied from data processing equipment, so that such dot line printers provide a very high degree of flexibility with regard to the printout content. Generally, each of the printer rods forms only a small number of the characters in a line of characters, e.g. the effective amount of horizontal traverse performed by the printer rods corresponds to the width of two, three or four characters, i.e. one or two columns in the printout.

In such dot line printers, the printer rods are mounted on individual leaf springs, which are normally held in a tensioned state by magnetic attraction exerted through a permanent magnet. When a dot is to be printed by one of the printer rods, a signal from the data processing equipment causes a pulse of current to flow in a coil corresponding to that printer rod, in a direction such as to nullify the magnetic force attracting the leaf spring of that printer rod. The restoring force of that leaf spring therefore acts to drive the printer rod rapidly outward from the printer head, to impact on the printer paper, and at about the instant of impact, the current flow in the corresponding coil is terminated, whereby the magnetic attraction acting on the leaf spring is restored. As a result of this attraction, and of the leaf spring naturally rebounding after impact on the printer paper, the leaf spring is rapidly returned to its previous position.

In order to achieve the highest possible printing speed with such a dot line printer, it is necessary to cause each printer rod to travel from its normal stationary position (i.e. the position in which it is held by magnetic bias provided from a magnetic circuit) to impact with the printer paper, as rapidly as possible, and to then to return to its stationary position, again as rapidly as possible. In addition, the momentum with which each printer rod impacts on the printer paper should be sufficiently high to enable a number of copies to be printed simultaneously, and should also be highly uniform, to ensure clearly printed dot patterns. With regard to speed of travel of the print rods to and from impact on the printer paper, the mechanical characteristics of the leaf springs are an extremely important factor. These characteristics should be optimized in relation to the gap between the printer rods and the paper, and should be highly uniform, to ensure uniformity of print quality. To achieve such optimum characteristics, the leaf springs should be manufactured from the most suitable materials, and formed into suitable shapes. However in the case of prior art types of printer heads for dot line printers, the leaf springs themselves form part of the magnetic paths which impart bias to the springs, and so must be formed of a magnetically permeable material, which does not necessarily provide optimum mechanical characteristics. Again, since the leaf springs form part of the magnetic circuit paths, the shape and cross-sectional area of each spring must be determined to some extent by magnetic path considerations, rather than by considerations of attaining optimum mechanical characteristics. Thus, such prior art types of printer heads do not permit leaf springs to be utilized which will permit the highest possible printing speeds to be attained. Another factor affecting printing speed is the manner in which magnetic flux is caused to build up and decay as a result of pulses of current applied to the coils, which momentarily counteract the magnetic bias applied to the printer rods and thereby cause printing to occur. To achieve the highest possible printing speeds, each current pulse must build up in a predetermined and uniform manner, and must be terminated at approximately the instant when the printer rod impacts on the paper, to allow the printer rod to immediately begin to return. However with prior art types of printer heads for dot line printers, the frame of the printer head itself forms part of the magnetic circuits which bias the leaf springs, i.e. is common to all of these magnetic circuits. Thus, magnetic coupling can occur between adjacent coils, through the frame, so that when a number of coils are driven simultaneously, mutual interference can occur between them. This interference affects the rate of buildup of the drive current pulses, and can cause these pulses to be terminated prematurely, i.e. before a printer rod has impacted on the printer paper. The attractive force exerted by the magnetic bias will thereupon act on the leaf spring of that printer rod, causing the printing density to be reduced. Due to this pehnomena, non-uniformity of printing can occur, with such prior art dot line printers, when a number of printer rods are actuated simultaneously.

Another consideration in the design of such printer heads is that the drive currents passed through the coils are of sufficient magnitude, that heating of the coils occurs, with the amount of such heating rapidly increasing as the printing speed is increased, i.e. as the rate at which current pulses are applied to the coils is increased. This heating results in heating of the frame, the printer head generally comprises a plurality of longitudinal members which are mutually attached and formed of different materials, bending distortion of the frame can occur, due to differences in the coefficients of linear expansion of these members. Thus, heat generated in the coils repesents a serious problem with regard to increasing the printing speed of prior art types of dot line printers.

With a printer head for a dot line printer according to the present invention, the above problems which arise with printer heads of the prior art are effectively overcome, by a novel design which offers the advantages of simplicity of construction and ease of manufacture. An important factor in this ease of manufacture lies in the fact that with a printer head for a dot line printer according to the present invention, the positions of the printer rods can be precisely adjusted, and the printer rods then fixed in position, without magnetic bias being applied to the leaf springs. In prior art types of printer head, this magnetic bias is acting on the leaf springs carrying the printer rods while such position adjustment is being performed, and since the precision of this adjustment is critical in determining the quality of printing attained, the resultant difficulty of position adjustment represents a serious disadvantage of such a prior art type of printer head for a dot line printer, from the aspect of ease of manufacture. With a printer head according to the present invention, the magnetic bias is produced by magnet blocks, each incorporating a permanent magnet, which are freely detachable from the printer head frame, so allowing position adjustment of the printer rods to be carried out without magnetic bias being applied thereto, and thereby greatly facilitating such position adjustment. In addition, with a printer head for a dot line printer according to the present invention, at least one magnetic circuit path is provided for each of the leaf springs, i.e. for each of the printer rods. Thus, the interference described above, resulting from mutual electromagnetic coupling between adjacent coils when a number of coils are driven at the same time, is virtually eliminated. This ensures uniformity of printing density, and also uniformity of printing copy capability.

SUMMARY OF THE INVENTION

A printer head for a dot line printer according to the present invention basically has the following configuration. A longitudinally extending frame, preferably formed of a lightweight metal, carries a plurality of leaf springs, with each leaf spring being attached at one end either directly to the frame or to a supporting member which is fixedly attached to the frame. The leaf springs are arrayed along the frame at fixed spacings, and each spring carries an armature at its free end, the armatures being formed of a magnetically permeable material while the leaf springs are formed from a suitable elastic material, not necessarily a magnetically permeable material. Each armature is provided with a print rod protruding outward therefrom, with the print rods comprising short narrow rod-shaped members, preferably formed of a highly wear-resistant material. The printer rods are arrayed along a common line, parallel to the longitudinal axis of the frame. A plurality of first yokes are also fixedly mounted on the frame, these being formed of a magnetically permeable material and each comprising a magnetic core and a bracket portion. The outer tip of each core faces the rear face of an armature, i.e. the opposite face of an armature to that from which a printer rod protrudes. A magnet block is mounted on each of the bracket portions of the first yokes, with each magnet block comprising at least a permanent magnet and a second yoke, the latter being formed of a magnetically permeable material and closely attached to the corresponding permanent magnet. Each magnet block is coupled magnetically and removably attached to a corresponding one of the first yokes, with the second yoke having a magnetic coupling portion formed thereon which is positioned closely adjacent to a side face of the magnetic core of the corresponding armature, and adjacent to the magnetic core of the corresponding first yoke, so that a magnetic circuit for the magnetic flux of the permanent magnet forms a path which passes from the first yoke, through the armature, and then through the magnetic coupling portion into the second yoke. Magnetic attraction is thereby exerted on each armature, whereby the corresponding leaf spring is pulled, against the restoring force exerted by the spring, such that the tip of the leaf spring impinges on the tip of the corresponding magnetic core. A coil is provided on each of the cores, and a pulse of current passed through such a coil causes magnetic flux to be produced in the core which opposes the magnetic flux from the permanent magnet, so that free end of the corresponding leaf spring is released from the magnetic attraction, so that the corresponding printer rod is driven outward by the spring away from the core tip. The printer head is coupled to a drive mechanism which causes the head to shuttle rapidly from side to side, with a linear or sinusoidal velocity variation, before a length of printer paper, which is advanced by a predetermined distance upon completion of each linear traverse of the printer head, with the direction of paper advancement being perpendicular to the line along which the printer head shuttles. The tips of the printer rods are arrayed closely adjacent to the printer paper, with a predetermined fixed spacing therebetween, and a printer ribbon passes over the paper between the tips of the printer rods and the paper. Thus, a dot is printed on the printer paper each time a current pulse is applied to a coil in the printer head, thereby causing the corresponding printer rod to fly outward and impact on the printer paper through the printer ribbon.

Thus, with a printer head for a dot line printer according to the present invention, an individual magnetic circuit can be provided for each of the leaf springs which carry the printer rods, without common magnetic coupling occurring through the frame, so that interference between the coils due to electro-magnetic induction is very substantially reduced by comparison with prior art printer heads. As a result, greater uniformity of printing density is attained, irrespective of the number of coils which are driven simultaneously. In addition, since the leaf springs can be formed of the most suitable material, without regard for the magnetic properties of that material, and since the shape and cross-sectional areas of the springs can also be designed to provide optimum performance, it becomes possible to attain substantially higher printing speeds than has hitherto been possible with such a dot line printer. Furthermore, the configuration of the frame of the printer head is designed such that apertures are provided for effective dissipation of heat from the coils, so that problems of heating resulting from coil drive currents applied during high speed printing are overcome. This problem is further alleviated by the fact that the frame consists of a single integrally formed longitudinal member, so that bending distortion of the frame due to the effects of heating on longitudinal members having different coefficients of linear expansion does not occur.

In addition to these advantages, since the magnet blocks are removably attached to the printer head assembly, adjustment of the positions of the printer rods can be carried out very precisely, at the time of manufacture, with the magnet blocks removed. In this condition, since the armatures and hence the free ends of the leaf springs are not held magnetically attracted against the tips of the cores, adjustment of the positions of the printer rods can be carried out with much greater ease than is possible with prior art types of printer head for a dot line printer. Also, due to the small size of each magnet block, the magnetization of these blocks can be readily performed using only a small size of magnetization apparatus. In addition, in the event of damage to a leaf spring or printer rod, the corresponding magnet block can be readily removed from the printer head, to permit easy replacement of the damaged component.

It can thus be understood that a printer head for a dot line printer according to the present invention provides important advantages with respect to practicability of manufacture and ease of maintenance, in addition to a capability for enhanced printing speed. These advantages may be more clearly understood by reference to the description of a preferred embodiment of a printer head for a dot line printer according to the present invention given hereinafter.

DESCRIPTION OF THE PREFERRED EMBODIMENTS

Figure 1:
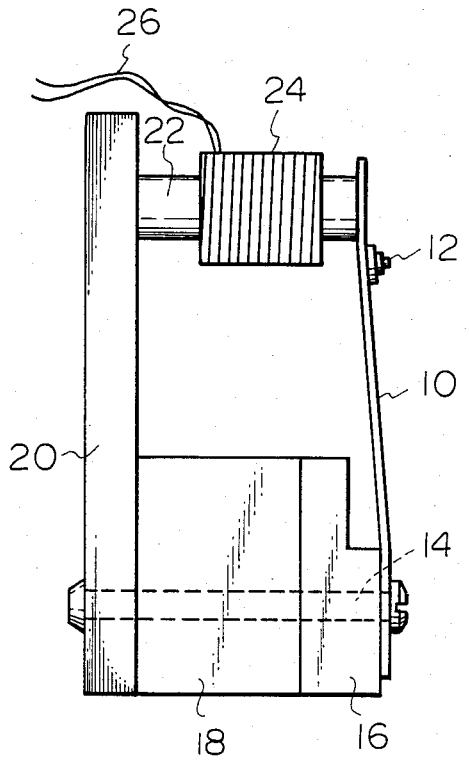
Fig. 1 PRIOR ART
FIG. 1 is a partial end view of a prior art printer head for a dot line printer, for illustrating components which form a magnetic circuit.

Referring to the drawings, FIG. 1 is a partial view taken from one end of a typical printer head for a dot line printer according to the prior art, with all components other than those essential in forming a magnetic circuit path being omitted from the drawing. Reference numeral 10 denotes one of a plurality of leaf springs, which are arrayed at regular spacings in a direction perpendicular to the plane of FIG. 1, with a narrow rod-shaped protrusion 12, referred to hereinafter as a printer rod, fixedly mounted on leaf spring 10, near one end thereof, and with the other end of leaf spring 4 being fixedly attached to support member 16 by means of a screw 14 which clamps together the leaf spring 10, support member 16, a permanent magnet 18, and a common magnetic path return member 20. The support member 16 and leaf spring 10 are formed of magnetically permeable materials. A plurality of coil cores (i.e. pole pieces) 22, also formed of a magnetically permeable material as is return member 20, are fixedly mounted on return member 20, with the tip of each coil core 22 being positioned opposite and adjacent to the free end of one of leaf springs 10. Support member 16 is mounted on one pole of permanent magnet 18, while the common return member 20 is mounted on the other pole. It can thus be understood that a magnetic circuit is formed, extending from one pole of permanent magnet 18 through common return member 20, coil core 22, leaf spring 10 (whose free end is pulled against the tip of coil core 22 by magnetic attraction), and supporting member 16. Leaf spring 10 is positioned such that its free end is pulled by magnetic attraction against the end of coil core 22, against a restoring force exerted by the spring. A coil 24 is wound around core 22, and when a pulse of current is passed through coil 24 via connecting leads 26 from an external circuit (not shown), magnetic flux is produced by coil 24 such as to oppose the magnetic flux in core 22 resulting from permanent magnet 18. The end of leaf spring 10 is thereby released from core 22, and is driven by the spring restoring force to fly rapidly away from the end of core 22, whereby the printer rod 12 impacts on a printer ribbon and printer paper (not shown) to print a dot on the paper. For maximum speed of printing with satisfactory print density, it is desirable that the attraction exerted by core 22 on leaf spring 10 should be restored immediately upon impact on the printer paper, i.e that the current in coil 24 producing a magnetic flux to nullify the latter attraction should cease to flow at the instant of impact. Leaf spring 10 will thereby be rapidly driven back onto the tip of core 22.

In such a prior art printer head, the common return member 20 and permanent magnet 18 each extend longitudinally in a direction perpendicular to the plane of FIG. 1, and each are common to all of the magnetic circuits of the plurality of leaf springs and coils 24. As a result, when drive current pulses are applied simultaneously to a number of coils, then these currents will mutually interfere, due to electro-magnetic coupling through the common return member 20. This interference is particularly severe in the case of mutually adjacent coils being driven simultaneously, and can result in cessation of drive current flow in the coils while the printer rods are in the process of flying toward impact on the printer paper. As a result, magnetic attraction by cores 22 will be restored at that instant, thereby slowing the velocity of the printer rods toward the paper, and causing a reduction in printing density on the paper. This phenomenon results in unevenness of printing, and is therefore highly undesirable.

A further problem which arises with such a prior art printer head for a dot line printer lies in the fact that the leaf springs 10 form part of a magnetic circuit, and therefore must be formed of some type of magnetic material. In order to attain maximum printing speed, the material forming leaf springs 10 should be selected on the basis of mechanical considerations, which will be determined by the shape of the springs and the amplitude of travel by the free ends of the springs, etc. However with such a prior art printer head, it is necessary to select the material for these springs based also on considerations of the magnetic properties of the material. The types of material which can be used to form leaf springs 10 is therefore severely limited, and it is not possible to select the optimum material for maximum printing speed.

Another problem which arises with regard to the leaf springs in such a prior art line printer lies in the fact that the shape of the springs cannot be freely determined on the basis of mechanical considerations, to provide the most rapid movement of the printer rods to and from impact on the printer paper, but must be suitable for constituting a part of the magnetic circuit path. In other words, the cross-sectional area of each spring cannot be reduced below a certain amount, throughout the length of a spring, as this will cause a reduction of the amount of magnetic flux in the magnetic circuit, and hence a reduction in the amount of attractive force exerted on the free ends of leaf springs 10 by the cores 22.

Figure 2:
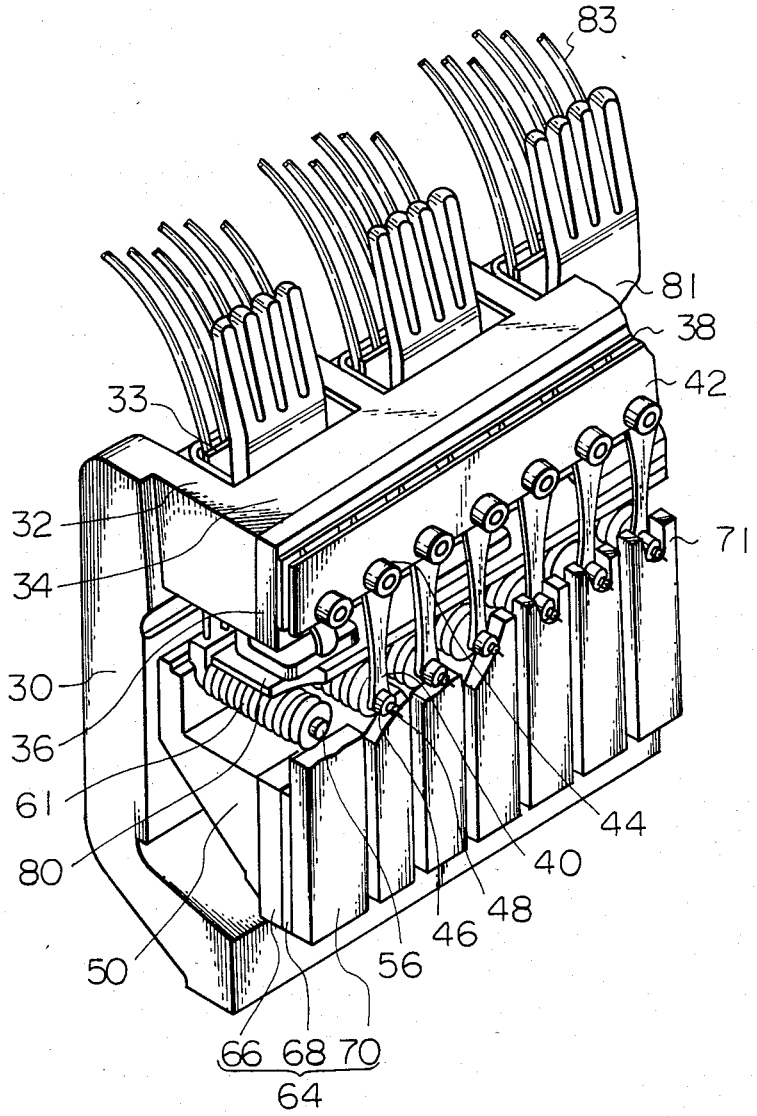
FIG. 2 is an oblique external view, partially cutaway, for illustrating the essential component structure of an embodiment of a printer head for a dot line printer according to the present invention.
Figure 3:
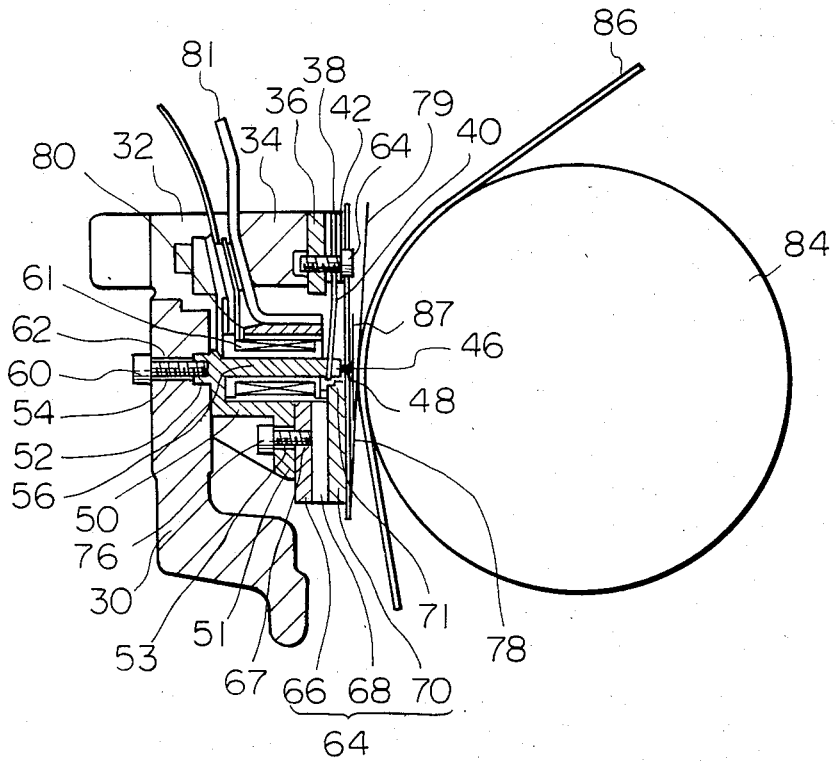
FIG. 3 is a cross-sectional view in elevation of the printer head of FIG. 2, and further illustrating a printer paper platen and ribbon.

An embodiment of a printer head for a dot line printer according to the present invention, designed to overcome the disadvantages of the prior art described above, will now be described, referring first to FIG. 2 and FIG. 3. FIG. 2 is an external partial oblique view of the printer head, taken with a cover removed and with part of the structure shown cut away, for ease of understanding. FIG. 3 is a cross-sectional view of the printer head embodiment of FIG. 2, but showing a cover attached in position, and also showing a platen, printer paper and printer ribbon, to assist in describing the operation of the printer head. Numeral 30 denotes a frame, which is formed as an integral unit from a non-magnetic metal having low specific weight. Frame 30 is of elongated shape, with only one end thereof being shown in FIG. 2. A leaf spring supporting section 34 of frame 30 is formed at the top of the frame, as shown, and behind this supporting section 34 are formed a plurality of supporting struts which extend from the rear of leaf spring supporting section 34, and are disposed at regular spacings, thereby forming a plurality of apertures 33 between struts 32. Provision of these apertures 33 serves to prevent distortion of frame 30 due to temperature increase, and also enable heat to be dissipated from a set of coils, by means described hereinafter. A leaf spring attachment member 36, formed of material having a suitably high level of mechanical durability, is attached to a vertical longitudinally extending face of leaf spring supporting section 34. A plurality of leaf springs 40, arrayed in line at regular spacings, are fixed in position by being clamped between leaf spring supporting member 36 and a clamp plate 42, with a spacer 38 being positioned between the leaf springs 40 and leaf spring supporting member 36, this clamping being performed by means of fixing screws 44, which are screwed into tapped holes provided in leaf spring supporting member 36, passing through holes provided in clamp plate 42.

Each of leaf springs 40 is provided with an armature 46, formed of a magnetically permeable material and having a cylindrical configuration. Each of armatures 46 is press-fitted into a hole provided in the free end of the corresponding leaf spring 40. A blind hole is formed in the outer face of each of armatures 46, and print rod 48, comprising a short, small-diameter rod, is fixed within this blind hole, and protrudes out of the armature 46. The printer rods 48 are formed of a material which is strong and abrasion-resistant, and serve to print dots on a printer paper by impacting thereon. A plurality of positioning holes 62 are formed in frame 30, arrayed in line at regular spacings which correspond to the spacings of leaf springs 40. A plurality of first yokes 50, formed of a magnetically permeable material are each provided with a cylindrical protrusion 52 formed at the base portion thereof which fits into a corresponding one of the positioning holes 62 in frame 30. Each of the first yokes 50 is fixedly attached to frame 30 by a first yoke attachment screw 60, passes through a positioning hole 62 and screws into a tapped hole 54 provided in the cylindrical protrusion of the corresponding first yoke 50. The first yokes 50 are thereby arrayed in line, at spacings corresponding to the spacings of leaf springs 40.

Each of first yokes 50 is also provided with a coil core 56, of cylindrical shape, which is substantially concentric with and extends in the opposite direction from the cylindrical protrusion 52 of that first yoke. The face of the tip of coil core 56 is positioned in relation to the rear face of the free end of a corresponding one of leaf springs 40 such that, in the absence of a magnetic attraction force acting mutually therebetween, a gap of predetermined size will exist between that core tip face and the rear face of the leaf spring 40, with that tip face being positioned adjacent to the rear of the corresponding armature 48. Each of first yokes 50 is also provided with a bracket section 51 integrally formed extending from the base in the same general direction as coil core 56, and spaced apart therefrom, having a through hole 53 formed therein. By forming first yokes 50 of a material such as silicon iron, these have a high degree of magnetic permeability together with high specific resistivity, thereby providing excellent magnetic flux characteristics and reducing the levels of eddy current flow therein.

A coil 61 is formed around each of coil cores 56, with each of these coils 61 being connected by leads 83 to an electric circuit (not shown in the drawings) from which drive signals to control the printing operation are supplied. A plurality of magnet blocks 64 are also mounted on frame 30, each being removably attached to a corresponding one of first yokes 50. Each of these magnet blocks 644 comprises a magnet attachment plate 66, a permanent magnet 68, and a second yoke 70, mutually fixedly attached in that order by suitable means such as an adhesive substance. A tapped hole 67 is formed in each of the magnet attachment plates 66, and a magnet block fixing screw 76 passing through the through hole 53 is screwed into tapped hole 67, to thereby removably attach magnet block 64 to the corresponding one of first yokes 50. As shown in FIG. 2, each of the second yokes 70 extends upwards towards the free end of the corresponding leaf spring 40, and is provided with a U-shaped cut-out portion provided in the upper end thereof. This U-shaped portion, referred to in the following as a magnetic coupling portion 71, is disposed such as to be adjacent to and to partially encircle the cylindrical surface of armature 46, with a small gap existing therebetween. In addition, this magnetic coupling portion 71 is positioned such that a predetermined spacing exists between the rear face of the upper end of second yoke 70 and the front face of the free end of the corresponding leaf spring 40 (the term "front" as used herein refers to the right-hand side of a component, as viewed in FIG. 2, while the term "rear" refers to the opposite side). As a result of this arrangement, the magnetic circuit path passing through second yoke 70, through an air gap into armature 46 and hence through coil core 56 (against whose tip face the rear face of armature 46 is normally held in contact by magnetic attraction) can be made very low, and strong magnetic attraction is exerted on armature 46, and hence on the free end of leaf spring 40, by the magnetic flux produced in this magnetic circuit by permanent magnet 68.

In addition, this U-shaped configuration of the magnetic coupling portion 71 assists in enabling the magnet blocks 64 to be easily detached from or attached to the printer head assembly, during manufacture or for maintenance purposes. Furthermore, also as a result of this U-shaped cut-out configuration of the magnetic coupling portion 71, the spacing between that portion of second yoke 70 and the armature 46 can be readily adjusted such as to adjust the degree of magnetic attractive force exerted on the free end of leaf spring 40.

In this embodiment, a separate magnetic circuit, based on one of magnet blocks 64, is provided for each of leaf springs 40. In each magnet block 64, the magnet attachment plate 66 abuts against one pole of the permanent magnet 68, while the second yoke 70 abuts against the opposite pole. It can thus be understood that a magnetic circuit is thereby formed which passes through first yoke 50, coil core 56, through armature 46 (and partially through the free end of leaf spring 40), through the air gap of the magnetic coupling portion 71, and then through second yoke 70. The magnetic flux in this magnetic circuit acts to hold armature 46, and hence the free end of leaf spring 46, against the tip face of coil core 56, and also serves to pull the free end of leaf spring 46 rapidly back against the tip of coil core 56 after impact of the corresponding printer rod on the printer paper has occurred.

Since the frame of the printer head is formed of a non-magnetic material, and an individual magnetic circuit is formed for each of leaf springs 40, mutual interference between coils 61 due to electromagnetic coupling between them will be minimized, even in the event of drive currents being passed through a number of coils on adjacent cores simultaneously.

The front of the printer head, including the front faces of the second yokes 70, is sealed against the entry of dust by means of a cover 78, not shown in FIG. 2. Apertures are formed in cover 78 which allow the printer rods to protrude outward when they are driven toward the printer paper. A ribbon mask 79 is also provided, which is attached along its lower end to the cover 78, by spot welding. A plurality of apertures, corresponding to those in the cover 78 are provided in ribbon mask 79, to permit the printer rods to reach the printer ribbon when they are driven outward towards the printer paper. The ink ribbon 87 is arranged between the ribbon mask 79 and cover 78, running along between these in a direction parallel to the line of printer rods 48.

In this embodiment, a magnetic path side member is also provided. This is formed of a suitable magnetically permeable material in the form of an elongated plate, and is closely attached to the upper sides of all of the coils 61. This magnetic path side member 80 serves to reduce mutual interference between the drive currents flowing in coils 61, and in particular to reduce the severe electro-magnetic interference which can occur when a number of adjacent coils are driven simultaneously. Use of this magnetic path side member 80, together with provision of seperate independent magnetic circuits for each of the coils, results in a high degree of suppression of such electro-magnetic induced interference between drive currents, and thereby effectively enables the repetion rate at which drive current pulses can be applied to the coils 61 to be increased, thereby enabling the printing speed to be increased. This increased speed is accompanied by improved uniformity of print density, and uniform copy-producing capability, since the speed at which each printer rod impacts the ink ribbon and paper during printing is made more stable than has been possible with prior art types of dot printer heads, as a result of this reduction of electro-magnetic interference effects occurring between the drive coils 61.

Numeral 81 denotes a plurality of heat dissipation fins, which are fixed in close contact to the upper face of magnetic path side member 80 and which protrude outward from the printer head assembly, through the apertures formed between struts 32. The magnetic path side member 80, in addition to the electro-magnetic interference reduction role described above, also serves to absorb and to uniformly distribute heat which is generated in coils 61 as a result of drive currents flowing therein. This heat is transferred from magnetic path side member 80 to heat dissipation fins 81, and hence dissipated to the atmosphere, thereby providing extremely effective heat dissipation and enabling high levels of drive current applied at high repetition rates to be applied to coils 61, to thereby enable high printing speeds to be attained.

It should be noted that the reduction of electro-magnetic interference between the drive currents flowing in coils 61, attained with this embodiment as described above, also serves to reduce heat generation within coils 61, since this type of interference can act to modify the waveforms of drive current pulses flowing in coils 61 such as to cause increased heat generation in the coils. This cause of increased heat generation in the coils becomes increasingly severe as the maximum printing speed (and hence repetition rate of drive current pulses passed through coils 61, is increased), and therefore has represented one of the problems hitherto encountered in increasing the speed of printing by dot line impact printers.

It is an important feature of a printer head for a dot line printer according to the present invention that leaf springs 40 do not form part of the magnetic circuits, i.e. need not be formed from a magnetic material. In the case of prior art printer heads, for simplicity of construction, the leaf springs themselves are made from a magnetically permeable material, and are thereby directly subjected to magnetic attraction. For this reason, the design of such prior art printer head leaf springs must be based on magnetic as well as mechanical considerations, and such magnetic considerations will affect the the shape of the springs as well as the material utilized in their construction. In other words, with a leaf spring forming part of a magnetic flux path, the cross-sectional area of the spring must be held above a certain level throughout the length of the spring, in order to provide sufficiently low magnetic reluctance. On the other hand, in order to reduce the time required for a printer rod to travel from a position of being magnetically retained against the tip of a coil core, into impact upon the printer paper, and then back onto the core tip, it is necessary to reduce the mass of the spring as far as possible. This can be achieved by selecting a suitable shape for the leaf spring, with appropriate variation of the cross-sectional area from the fixed end to the free end of a spring. Furthermore, it is necessary to utilize a suitable material to form the leaf springs, to attain maximum speed of travel of the printer rods. Thus with the present invention, as described above, an armature formed of a suitable magnetically permeable material is fixedly mounted at the free end of each of leaf springs 40, while the material of the leaf springs themselves plays no part in the magnetic circuit. Furthermore, as illustrated in FIG. 2, the shape of each of leaf springs 40 in a printer head according to the present invention is formed such as to minimize the overall mass of the spring, or more specifically, such as to minimize the effective inertia of each of armatures 46. This is achieved by adopting a basically tapered shape for each of leaf springs 40, or a shape in which the intermediate portion along the length of a spring is of smaller width than the width at the fixed end and that at the free end of the spring.

Such a reduction in the effective inertia of each of armatures 46 is extremely important, in achieving a high printing speed and long operating life. When the free end of one of leaf springs 40 is released from a condition of being magnetically retained against a core tip, due to a drive current being passed through the corresponding coil 61, and subsequently impacts upon the printer ribbon and paper, then in order to attain the highest possible printing speed, the printer rod should thereupon immediately fly back to the core tip. However in the case of the material, shape and size of the leaf spring being determined by magnetic considerations, so that the mechanical characteristics are not optimized, the printer rod may, due to excessive inertia, remain pressing against the paper and platen for an unnecessary time duration. In addition, the rear face of the leaf spring may thereafter bounce or rub against the magnetically attracting surface of the core tip upon return thereto, further increasing the time required to perform each dot printing operation. These phenomena occurring at the time of impact upon the printer platen and on the core tip will result in rapid distortion of the platen surface, and in wear of the faces of the leaf spring and core tip which come into contact, thereby reducing the operating life of the printer, as well as limiting the maximum printing speed attainable. In addition to these phenomena, torsional vibration of the leaf spring in the course of travel toward impact with the printer paper, and during return therefrom, which further tends to increase, or at least to make unstable, the time required to perform each dot printing operation.

With a printer head according to the present invention however, these problems are substantially eliminated, by selecting suitable material for the leaf springs 40, and forming these springs into the optimum shape and optimum thickness with regard to the distance to be travelled by each printer rods from a magnetically retained position to impact with the printer paper, and with regard to the level of attractive force exerted on each of armatures 46 by the corresponding core. Optimizing the leaf spring characteristics in this way leads to a significant increase in the maximum printing speed attainable, together with increased reliability and longer operating life.

Another severe problem which arises with prior art types of dot line printers lies in the need for machining and positioning certain components in relation to one another, such as to provide a predetemined level of bending force, i.e. restoring force exerted at the free end of each leaf spring, this force normally acting in opposition to the force of magnetic attraction produced by the corresponding magnetic circuit. If the springs are assumed to have identical mechanical characteristics, then the magnetude of this restoring force will be determined essentially by the amount of deflection of the free end of a leaf spring relative to the fixed end. This deflection will be determined by the relative positions of a magnetically atracting face (i.e. the tip face of the corresponding coil core) and a face upon which the fixed end of a leaf spring is attached. In the prior art, the components upon which these faces are formed are generally manufactured and machined as separate items, and their relative positions after assembly of the printer head will therefore be dependent on the precision with which this machining has been performed or upon the degree of precision with which the relative positions are adjusted at the time of assembly. In the latter case, the cost of machining will be extremely high, while in the latter case it is necessary to use expensive measurement equipment and excessive labor time to perform adjustment. If the levels of the restoring force exerted by the leaf springs are not sufficiently uniform, then satisfactory operation will not be obtained, since the printing density will not be uniform. For these reasons, it has not be possible hitherto to produce a dot line printer providing high printing quality together with a low manufacturng cost.

Figure 4:
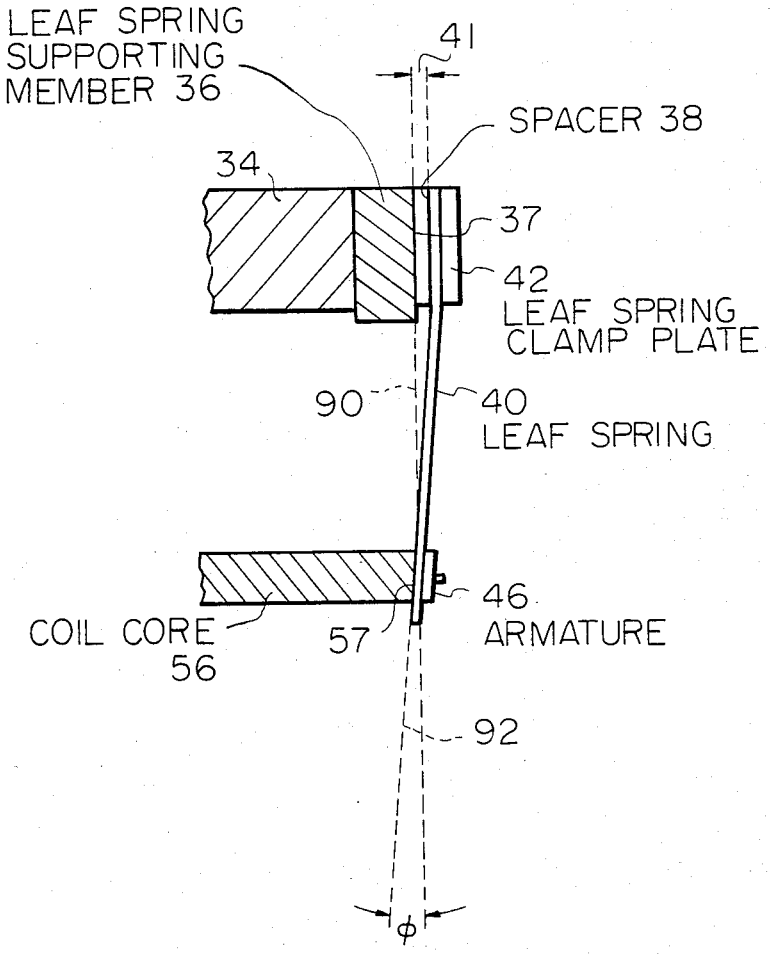
FIG. 4 is a partial cross-sectional view of the printer head embodiment of FIG. 1 and 2, for illustrating the positional relationships between a leaf spring support member and the tip of a coil core.

These problems are effectively overcome with a printer head according to the present invention as will now be described with reference to FIG. 4. This is a simplified partial cross-sectional view of the printer head embodiment of FIG. 2 and FIG. 3, for illustrating the positional relationships between one of leaf springs 40, the corresponding coil core 56, and the face 37 of a leaf spring supporting member 36. With leaf spring 40 in the condition in which the free end thereof is held magnetically attracted against the tip face of coil core 56, the level of magnetic attractive force acting on leaf spring 40 must be sufficient to overcome the restoring force exerted by leaf spring 40 as a result of its deflection. The level of this restoring force will be determined by the mechanical characteristics of leaf spring 40, i.e. by the thickness, shape and material of the spring, and by the amount of spring deflection in this magnetically attracted state, i.e. by the amount of relative displacement 41 between the free end of leaf spring 40 and the fixed end thereof. The force of magnetic attraction acting on the free end of leaf spring 40, i.e. on armature 46, for the static deflected condition shown in FIG. 4, can be maximized by arranging that the end face of coil core 56, denoted by numeral 57, is co-planar with the rear face of the free end of leaf spring 40 when that rear face is held against face 57 by magnetic attraction. This condition can be satisfied by forming a suitable flat bevelled face as tip face 57 of coil core 56, as described hereinafter. The amount of relative displacement 41 between the free end and the fixed end of leaf spring 40 is determined in this embodiment by the thickness of spacer 38, since the outermost tip of bevelled end face 57 of coil core 56 is positioned in the same plane 90 as the longitudinal vertical outer face 37 of leaf spring supporting member 36, i.e. the face against which spacer 38 abuts.

It is relatively easy to manufacture spacer 38 at low cost, as an elongated flat plate whose thickness is fixed to a high degree of precision. However using prior art methods of manufacture, it would be difficult and expensive to precisely set the relative positions of outer face 37 of leaf spring supporting member 36 and the tip face 57 of coil core 56, and to set these positions in relation to the angle of inclination of bevelled tip face 57. However with the present embodiment of printer head according to the present invention, this difficulty is overcome by performing machining and assembly of the components shown in FIG. 3 and FIG. 4 as follows.

Firstly, leaf spring supporting member 36 and all of coil cores 56 are fixedly attached to frame 30, by means described herein above. The outer vertical face 37 of leaf spring supporting member 36 and the end face of coil core 56 are then machined such as to become precisely co-planar, i.e. such that both faces come into the plane denoted by numeral 90 in FIG. 4 (i.e. a plane extending perpendicular to the plane of FIG. 4). In this condition, machining of the tip face of coil core 56 is then performed, to form a flat bevelled face in a plane making an angle $\phi$ with respect to plane 90. This machining is continued until the previously formed flat face formed in plane 90 on the tip face of coil core 56 is completely removed, at which point machining of coil core 56 is terminated.

In this condition, a flat bevelled face 57 has been formed as the tip face of coil core 56, which lies in a plane 92, inclined at predetermined angle $\phi$ with respect to the plane 90 of end face 37 of leaf spring supporting member 36. In adddition, the outermost point of tip face 57 will now lie in the same plane as end face 37 of leaf spring supporting member 36. The spacer 38, all of leaf springs 40, and leaf spring clamp plate 42 are then assembled as described hereinabove, and the positions of printer rods 48 are precisely set.

This position setting can be rapidly and easily carried out, since at this point no magnetic attraction is being exerted upon armatures 46, causing the ends of leaf springs 40 to be attracted to the tips of coil cores 56. This positioning of the printer rods can be readily performed by utilizing a suitable positioning tool or jig, having an array of apertures at the desired positions of the printer rods, into which the printer rods are fitted. Leaf spring clamp plate 42 can then be tightened to clamp leaf springs 40 in place as described hereinabove. The magnet blocks 64 can then be fixed in place, whereupon the free ends of leaf springs 40 will be brought into contact with the tip faces of the corresponding coil cores 56 i.e. into the deflected state shown in FIG. 4.

The value of angle 100 is selected such that the rear face of the free end of each of leaf springs 40 comes into close contact over the entire area of the bevelled tip face 57 of the corresponding coil core 56, so that a maximum amount of attractive magnetic force is applied to retain each of leaf springs 40 in the deflected state, against the restoring force exerted by the spring. This high level of magnetic attractive force exerted on leaf springs 40 helps to ensure more stable printing operation and uniform printing density, due to the fact that rebound of armature 46 from the tips face of coil core 56 is substantially eliminated by the high attractive force, and is also of assistance in attaining higher printing speeds, since elimination of each rebound enables reduction of the time which must elapse after a printing operation by a printer rod before the next operation by that printer rod. In addition, prevention of such rebounding of the armatures from the tip faces of coil cores 56 serves to reduce the rate of wear of the latter tip faces and the rear faces of the free ends of leaf springs 40.

It will be apparent that the configuration of a printer head according to the present invention as described above, in conjunction with a method of manufacture such as that described, results in the elimination of requirements for high precision working of components before assembly, or for highly precise measurements of the relative positions of components at the time of assembly, and that only a capability for machining metal surfaces to come precisely within a predetermined plane is necessary. With such a configuration and assembly method, the amount of deflection of each of leaf springs 40, i.e. the relative displacement between the fixed end and the free end of each spring in the magnetically retained state, is essentially determined by the thickness of the spacer 38, and as stated above, this thickness can be set to a high degree of precision by known methods of manufacture at low cost. Thus, the configuration and method of manufacture adopted for this embodiment of the present invention enable a printer head for a dot line printer to be produced which provides a very high printing speed, highly uniform printing density, yet which can be manufactured at a lower cost than has hitherto been practicable for such printer heads.

It should be noted that, to achieve a long operating life, it is desirable to form a cladding layer of a highly abrasion-resistant material upon the faces of coil core 56 and leaf springs 40 which come into impact when the free ends of leaf springs 40 are magnetically attracted onto the cores. However the use of such a cladding layer does not alter the basic features of the configuration and method of manufacture of a printer head according to the present invention as described above. If such cladding layers are incorporated, then their effects can be compensated by a suitable increase in the thickness of spacer 38, to thereby obtain the desired amount of relative displacement 41 between the free end and fixed end of each of leaf springs 40.

From the above description of the preferred embodiment of a printer head according to the present invention, it can be understood that such a printer head provides substantial advantages over the prior art, with respect to increased maximum printing speed, improved uniformity of printing density, higher reliability, together with substantially lower cost of manufacture and ease of maintenance.

Although the present invention has been shown and described with reference to a specific embodiment, it should be noted that various changes and modifications to that embodiment may be envisaged, which fall within the scope claimed for the present invention as set out in the appended claims. The above specification should therefore be interpreted in a descriptive and not in a limiting sense.

What is claimed is:

1. A printer head for a dot line printer in which the printer head performs impact printing of dot patterns on a periodically advanced printer paper, comprising:

an integrally formed elongated frame composed of a non-magnetic metal and disposed longitudinally in a direction perpendicular to the direction of advancement of said printer paper;

a plurality of first yokes formed of a magnetically permeable material and arrayed at regular spacings along said frame, each of said first yokes having a base portion with a first side fixedly attached to a longitudinally extending plane surface of said frame, each of said first yokes being formed with a coil core protruding from said base portion on a side thereof opposite to said first side and further being formed with a bracket portion protruding from said base portion in the same general direction as said coil core and spaced apart from said coil core;

a plurality of coils each formed around a corresponding one of said coil cores, each of said coil cores having a tip;

a plurality of magnet blocks each attached to a corresponding one of said first yokes and each comprising a permanent magnet and a second yoke mutually attached, each of said second yokes being formed of a magnetically permeable material and having a U-shaped cutout portion formed at an end portion thereof which is disposed adjacent to the tip of the corresponding coil core, and each of said permanent magnets having a pair of magnetic poles with magnetic flux paths, one magnetic pole thereof being coupled to the corresponding first yoke and the opposite magnetic pole being coupled to the corresponding second yoke;

a plurality of leaf springs arrayed along said frame, leaf spring attachment means attaching said leaf spring to said frame, each of said leaf springs having a fixed end and a free end, said fixed ends being fixedly attached to said frame by said leaf spring attachment means at a position which is substantially completely outside the magnetic flux paths of said permanent magnets, said free ends of said leaf springs being disposed adjacent to the tip of a corresponding one of said coil cores;

a plurality of armatures each formed of a magnetically permeable material and fixedly attached to the free end of a corresponding one of said leaf springs at a position directly opposite and adjacent to an end face of the tip of the corresponding coil core such as to be spaced apart therefrom in the absence of the corresponding magnet block and to be attracted onto said tip face when said corresponding magnet block is installed, said U-shaped cutout portion of the corresponding second yoke partially surrounding the periphery of said armature with an air gap therebetween, whereby a major proportion of the magnetic flux of the corresponding permanent magnet passes from the corresponding second yoke, through said air gap, through said armature, and into said coil core;

a plurality of printer rods arrayed in line, each having a narrow rod-shaped configuration and being fixedly attached to a corresponding one of said armatures and protruding therefrom;

each of said magnet blocks in conjunction with the corresponding first yoke and armature acting to form a path for the magnetic flux of the corresponding permanent magnet, said magnetic flux acting to retain the free end of the corresponding leaf spring in contact with the tip of the corresponding coil core by magnetic attraction exerted on the corresponding armature, and said leaf spring attachment means being arranged such as to provide a desired degree of displacement between the free end and fixed end of each said leaf springs, as measured in a direction perpendicular to the plane of the spring, in said magnetically retained condition, whereby a restoring force corresponding to said degree of displacement is exerted by each of said leaf springs in said magnetically retained condition, each of said coils being responsive to a pulse of drive current passed therethrough for momentarily producing a magnetic flux acting in opposition to the magnetic flux of the corresponding permanent magnet to thereby momentarily release the corresponding leaf spring from the magneticaly retained condition, whereby the corresponding printer rod is caused to impact on said printer paper.

2. A printer head for a dot line printer according to claim 1, in which said leaf spring attachment means comprise a leaf spring supporting member attached to said frame and having longitudinally extending plane face defining a plane, a spacer member of flat elongated shape which is positioned to abut against said plane face, and clamp means for clamping the fixed ends of each of said leaf springs against said spacer member.

3. A printer head for a dot line printer according to claim 2, in which each of said coil cores is of cylindrical form and has the tip face thereof bevelled into a plane which is inclined with respect to the plane of said plane face of said leaf spring supporting member, said tip face having an outermost point at its outermost longitudinal end, said outermost point of said bevelled tip face being positioned in the plane of said plane face of said leaf spring supporting member.

4. A printer head for a dot line printer according to claim 1, in which each of said leaf springs is of fixed thickness and is formed such that a central portion thereof is of smaller breadth than the breadths of said fixed and and free end thereof.

5. A printer head for a dot line printer according to claim 1, in which said frame is integrally formed with a longitudinally extending leaf sping support section having said leaf springs attached thereto by said leaf spring attachment means, said leaf spring supporting section being in the form of a shelf which protrudes in substantially the same direction as said coil cores.

6. A printer head for a dot line printer according to claim 5, and further comprising a plurality of heat dissipation fins each having a portion thereof positioned adjacent to said coils, for absorbing heat therefrom.

7. A printer head for a dot line printer according to claim 1, and further comprising a magnet path side member in the form of an elongated flat plate formed of a magnetically permeable material, which is fixedly held in contact with all of said coils to reduce magnetic induction effects between said coils.

8. A printer head for a dot line printer according to claim 1, in which each of said magnet blocks further comprises a magnet attachment plate formed of a magnetically permeable material and fixedly attached to said permanent magnet on the pole thereof opposite to that pole to which said seond yoke is attached, and screw attachment means securing said magnetic attachment plate to the corresponding first yoke.

* * * * *